US007380772B1

(12) United States Patent
Pattullo et al.

(10) Patent No.: US 7,380,772 B1
(45) Date of Patent: Jun. 3, 2008

(54) CHARGE FORMING DEVICE WITH CONTROLLED AIR BYPASS

(75) Inventors: George M. Pattullo, Caro, MI (US); Thomas L. Schmidt, Cass City, MI (US)

(73) Assignee: Walbro Engine Management, L.L.C., Tucson, AZ (US)

( * ) Notice: Subject to any disclaimer, the term of this patent is extended or adjusted under 35 U.S.C. 154(b) by 0 days.

(21) Appl. No.: 11/591,068

(22) Filed: Nov. 1, 2006

(51) Int. Cl.
*F02M 3/12* (2006.01)

(52) U.S. Cl. ..... 261/46; 123/339.23; 261/47; 261/DIG. 1

(58) Field of Classification Search ..... 261/45–47, 261/54–56, 63, DIG. 1; 123/339.23
See application file for complete search history.

(56) References Cited

U.S. PATENT DOCUMENTS

| | | | | |
|---|---|---|---|---|
| 2,789,801 | A * | 4/1957 | Durbin | 261/46 |
| 3,174,469 | A * | 3/1965 | Rappolt | 123/586 |
| 4,073,278 | A * | 2/1978 | Glenn | 123/198 F |
| 4,083,342 | A * | 4/1978 | Bertling | 123/700 |
| 4,752,420 | A * | 6/1988 | Nagasaka et al. | 261/35 |
| 5,709,822 | A | 1/1998 | Togashi | |
| 5,740,781 | A * | 4/1998 | Scott et al. | 123/437 |
| 6,283,460 | B1 * | 9/2001 | Omarsson | 261/50.1 |
| 6,328,288 | B1 * | 12/2001 | Gerhardy | 261/35 |
| 6,349,925 | B1 * | 2/2002 | Tobinai et al. | 261/23.3 |
| 6,585,235 | B2 | 7/2003 | Pattullo | |
| 6,708,958 | B1 * | 3/2004 | Warfel et al. | 261/45 |
| 6,749,180 | B2 * | 6/2004 | Durr et al. | 261/23.3 |
| 6,843,469 | B1 * | 1/2005 | Nonaka | 261/44.3 |
| 6,851,664 | B2 | 2/2005 | Gangler et al. | |
| 6,877,723 | B2 * | 4/2005 | Martinsson et al. | 261/23.3 |
| 6,896,245 | B2 * | 5/2005 | Suzuki et al. | 261/23.2 |
| 7,104,526 | B2 * | 9/2006 | Mavinahally | 261/46 |
| 7,261,281 | B2 * | 8/2007 | Raffenberg | 261/44.8 |
| 7,275,508 | B2 * | 10/2007 | Pattullo | 123/179.18 |
| 7,287,742 | B2 * | 10/2007 | Burns | 261/50.1 |
| 2003/0160340 | A1 * | 8/2003 | Durr et al. | 261/16 |
| 2004/0065965 | A1 * | 4/2004 | Warfel et al. | 261/52 |
| 2004/0130039 | A1 * | 7/2004 | Suzuki et al. | 261/23.2 |
| 2004/0251564 | A1 * | 12/2004 | Mavinhally | 261/23.3 |
| 2005/0001335 | A1 * | 1/2005 | Nonaka | 261/44.3 |
| 2005/0062176 | A1 * | 3/2005 | Nonaka | 261/50.2 |
| 2006/0125125 | A1 * | 6/2006 | Seki et al. | 261/45 |

FOREIGN PATENT DOCUMENTS

| | | | | |
|---|---|---|---|---|
| JP | 56-18052 A * | 2/1981 | | 261/54 |

* cited by examiner

*Primary Examiner*—Richard L. Chiesa
(74) *Attorney, Agent, or Firm*—Reising, Ethington, Barnes, Kisselle, P.C.

(57) ABSTRACT

A charge forming device includes a body with a fuel and air mixing passage, a bypass passage that communicates with the fuel and air mixing passage, a throttle valve and a choke valve. The throttle valve is movable between idle and wide open positions and operable to control at least in part the fluid flow through the fuel and air mixing passage. The choke valve is movable between an open position permitting a substantially free flow of air into the fuel and air mixing passage and a closed position at least substantially restricting air flow into the fuel and air mixing passage. A bypass valve is movable between an open position and a closed position to selectively permit fluid flow through the bypass passage. The bypass valve is movable toward its open position when the throttle valve is displaced at least a threshold amount away from its idle position.

19 Claims, 4 Drawing Sheets

CHARGE FORMING DEVICE WITH CONTROLLED AIR BYPASS

FIELD OF THE INVENTION

The present invention relates generally to internal combustion engines and more particularly to a charge forming device for such engines.

BACKGROUND OF THE INVENTION

Small internal combustion engines may be used in various devices including recreational vehicles and garden implements such as chain saws, lawn mowers and string trimmers. Some of these devices have pull cord type starting systems that require a retractable cord to be pulled by a user of the device to start it. In a recoil starter mechanism, pulling the cord rotates a recoil pulley which, through a one way clutch, rotates a crank shaft of the engine to start the engine.

SUMMARY OF THE INVENTION

A charge forming device includes a body defining at least part of a fuel and air mixing passage and a bypass passage that communicates with the fuel and air mixing passage, and a throttle valve and a choke valve. The throttle valve is carried by the body for movement between idle and wide open positions and operable to control at least in part the fluid flow through the fuel and air mixing passage. The choke valve is operably associated with the fuel and air mixing passage, and movable between an open position permitting a substantially free flow of air into the fuel and air mixing passage and a closed position at least substantially restricting air flow into the fuel and air mixing passage. A bypass valve associated with the bypass passage is movable between an open position and a closed position to selectively permit fluid flow through the bypass passage. The bypass valve is movable toward its open position when the throttle valve is displaced at least a threshold amount away from its idle position.

In one implementation, the charge forming device includes a carburetor and at least one bypass valve is carried by the throttle valve and at least one bypass valve is carried by the choke valve. The bypass valves permit air flow therethrough when the choke valve is moved toward its closed position and the throttle valve is moved toward its wide open position, such as during a choke assisted start of an engine at wide open throttle. Of course, other arrangements of the bypass, throttle and choke valves may be utilized, as desired for different applications.

BRIEF DESCRIPTION OF THE DRAWINGS

These and other objects, features and advantages of the present invention will be apparent from the following detailed description of preferred embodiments and best mode, appended claims and accompanying drawings in which:

DETAILED DESCRIPTION OF PREFERRED EMBODIMENTS

Figure 1:
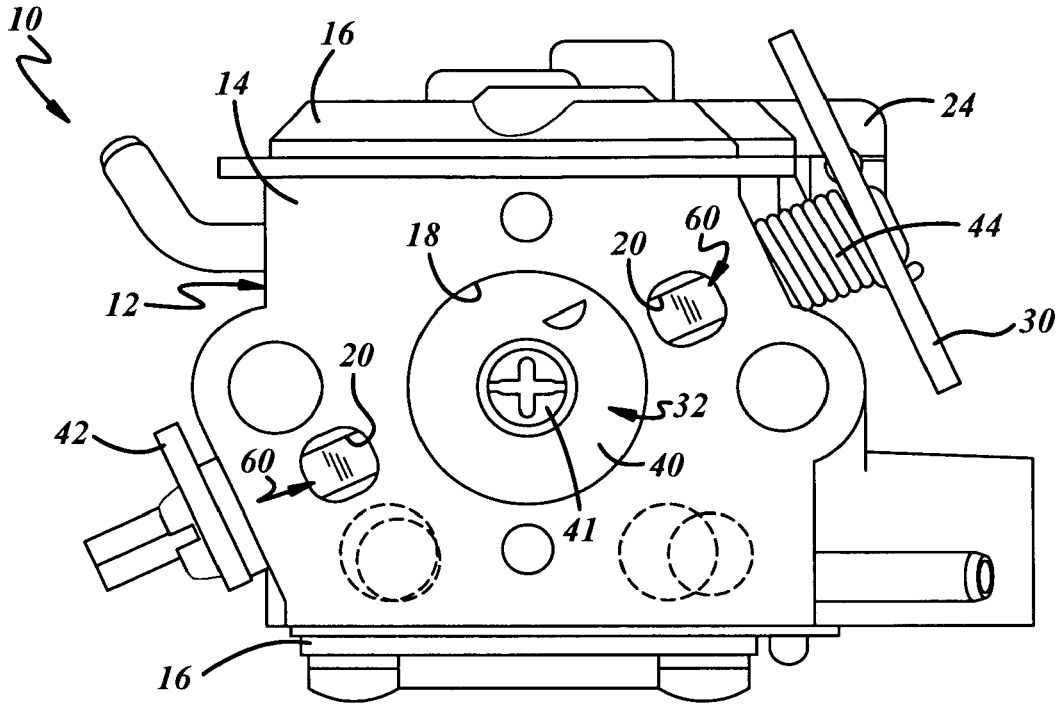
FIG. 1 is a side view of one embodiment of a charge forming device with a throttle valve in its idle position.
Figure 2:
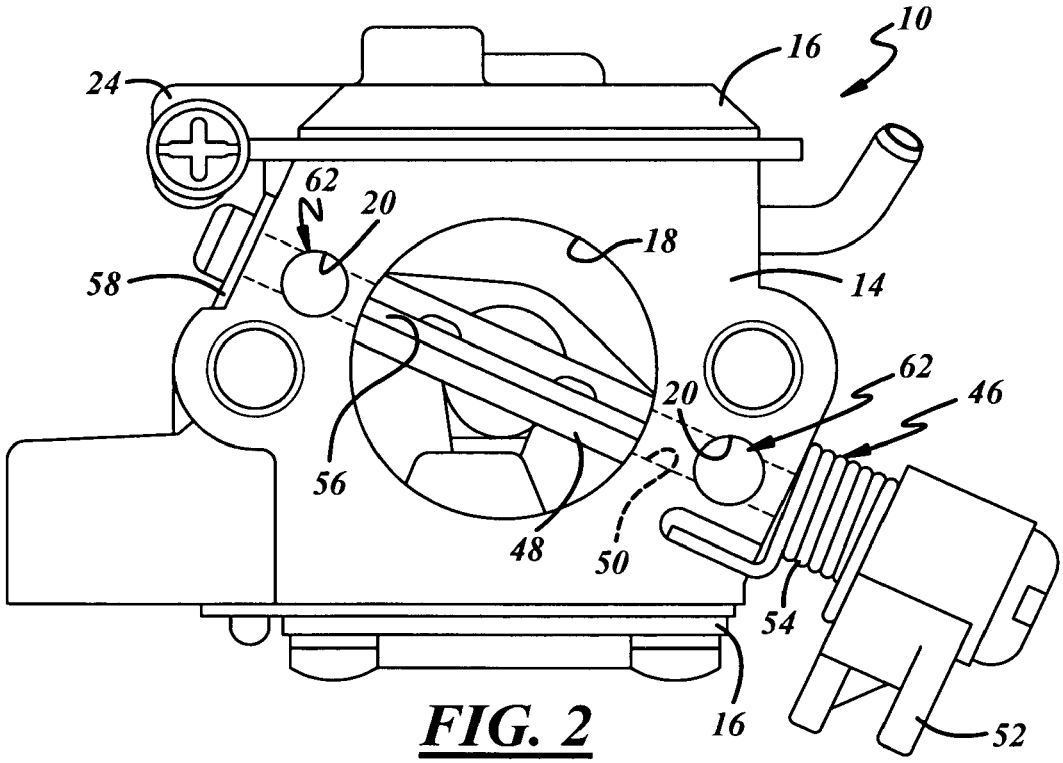
FIG. 2 is a side view of the charge forming device of FIG. 1 illustrating a choke valve in its open position.
Figure 3:
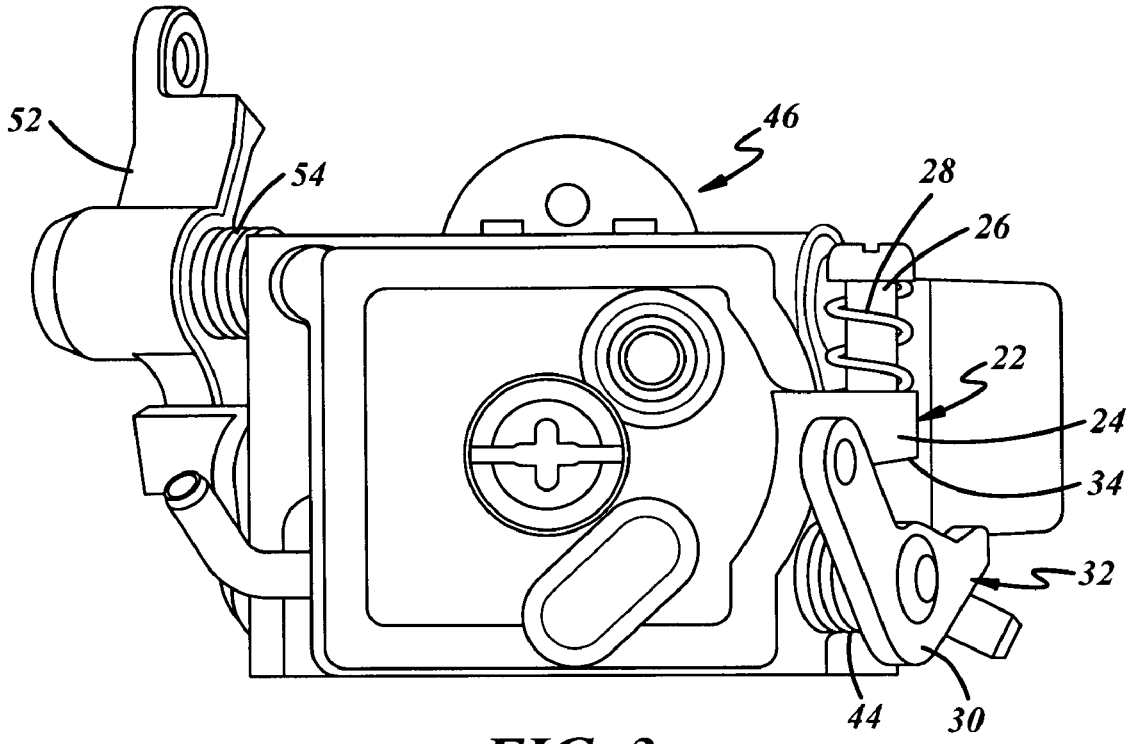
FIG. 3 is a plan view of the charge forming device.
Figure 4:
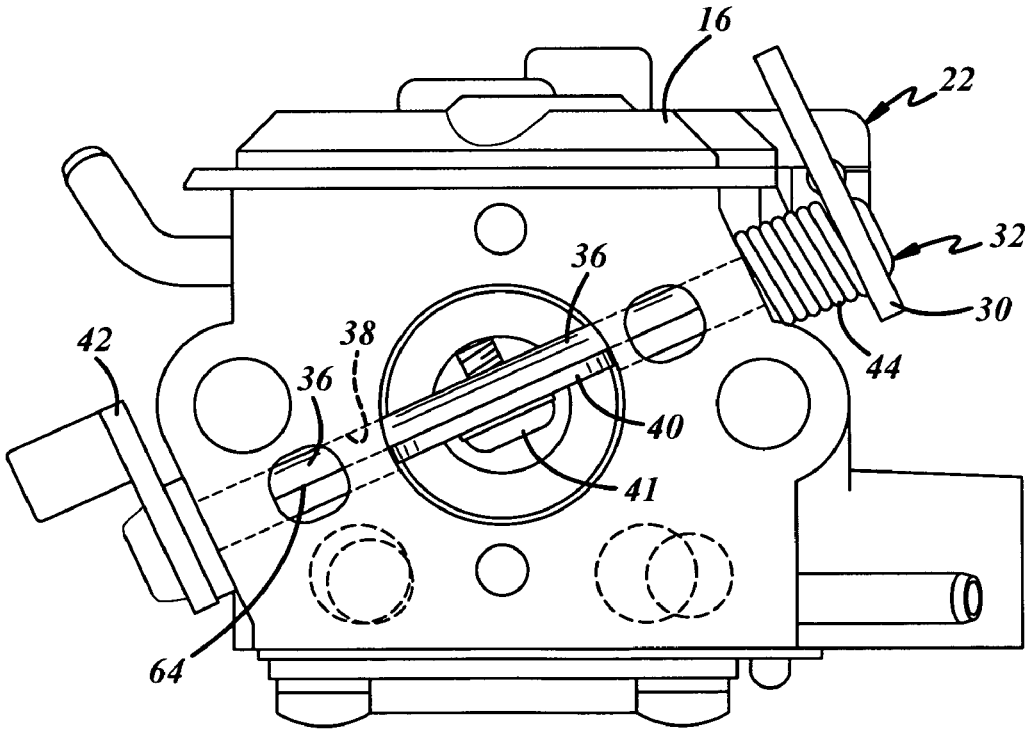
FIG. 4 is a side view of the charge forming device illustrating the throttle valve in its wide open position.

Referring in more detail to the drawings, FIGS. 1-4 illustrate a charge forming device 10, such as a carburetor, that has a main body 12 including a central block 14 and one or more plates 16 attached to the block 14. The carburetor 10 may be a diaphragm-type carburetor that includes a flexible fuel pumping diagram and a flexible fuel metering diaphragm (not shown). In that regard, the carburetor may be constructed generally as disclosed in U.S. Pat. No. 4,752,420, the disclosure of which is incorporated herein by reference in its entirety.

The main block 14 includes a fuel and air mixing passage 18 formed therethrough and communicating with a fuel metering chamber (not shown). Fuel from the metering chamber is provided into an air flow through the fuel and air mixing passage 18 to provide a fuel and air mixture to an operating engine. At least one air bypass passage 20 is also provided, preferably in the main block 14. In the implementation shown, two bypass passages 20 are formed in the carburetor 10. The bypass passages 20 may be disposed on generally diametrically opposed sides of the fuel and air mixing passage 18 and are adapted to permit air to flow therethrough to, at least under certain engine conditions, permit additional air flow to the engine, as will be discussed in more detail herein.

The carburetor body 12 preferably also includes an outwardly extending stop 22 which as shown, is carried by a plate 16 attached to the block 14 of the carburetor body. A protrusion 24 may include a threaded bore in which a threaded idle adjustment screw 26 is received. A spring 28 may be disposed about the shank of the idle adjustment screw 26 between its head and the protrusion 24. An end of the idle adjustment screw 26, opposite its head, extends through the protrusion 24 and is adapted to engage a position limiting lever 30 of a throttle valve 32 to define the idle position of the throttle valve 32. Accordingly, advancing or retracting the idle adjustment screw 26 relative to the protrusion 24 permits adjustment of the idle position of the throttle valve 32. The protrusion 24 itself may provide a stop 34 (FIG. 3) engageable by the throttle valve lever 30 to define the wide open position of the throttle valve 32 by limiting rotation of the throttle valve 32 away from its idle position.

In the implementation shown, the carburetor throttle valve 32 is a butterfly type valve that includes a valve shaft 36 rotatably carried in a bore 38 extending in the block 14, through the fuel and air mixing passage 18 and through each bypass passage 20. The throttle valve 32 also includes a valve head 40 which may be a flat disc fixed to the shaft 36, such as by a fastener 41, for corotation with the shaft. The throttle valve 32 may further include the position limiting lever 30 as previously recited, and at its opposite end, a start assist lever 42 extending generally radially outwardly from the shaft 36 and fixed to the shaft for rotation therewith. A spring 44 may be disposed about the throttle valve shaft 36 with one end of the spring engaged with the carburetor body 12 and its other end engaged with the position limiting lever 30 to yieldably bias the throttle valve 32 to its idle position wherein the valve head 40 substantially prevents fluid flow out of the fuel and air mixing passage 18.

Figure 5:
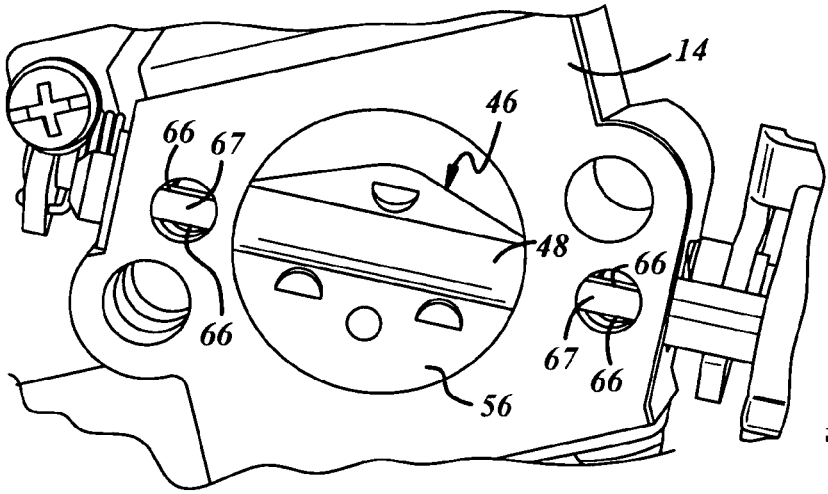
FIG. 5 is a fragmentary side view illustrating the choke valve in its closed position.

The carburetor 10 may also include a choke valve 46, as is known in the art. The choke valve 46 is disposed upstream of the throttle valve 32 and preferably includes a shaft 48 rotatably carried by the carburetor such as in a bore 50 formed in the block 14 and extending through the fuel and air mixing passage 18 and the bypass passages 20. The choke valve shaft 48 may extend parallel to the throttle valve shaft 36. The choke valve 46 preferably also includes a start assist lever 52 disposed on the same side of the carburetor as the start assist lever 42 of the throttle valve 32. A return spring 54 can be disposed about the choke valve shaft 48 and engaged at one end with the carburetor body 12 and at its other end with the start assist lever 52 to yieldably bias the choke valve 46 to its open position wherein a substantially unrestricted flow of air is permitted into the fuel and air mixing passage 18. Opposite the start assist lever 52, the choke valve shaft may extend out of the carburetor body 12 and be retained thereto by a suitable retainer, such as a clip or other fastener 58. The choke valve 46 may also be of a butterfly type having a flat disc valve head 56 fixed to the choke valve shaft 48 and being complementary shaped to the adjacent portion of the fuel and air mixing passage 18 to substantially close the fuel and air mixing passage 18 when the choke valve 46 is rotated to its closed position, shown in FIG. 5. The choke valve may not fully close the fuel and air mixing passage 18 to permit a limited, calibrated air flow therethrough when closed or in a "start" position. This may be done by providing a hole in the valve head 56, or by providing a peripheral gap between the valve head 56 and carburetor body through which air may flow into the fuel and air mixing passage 18.

Figure 10:
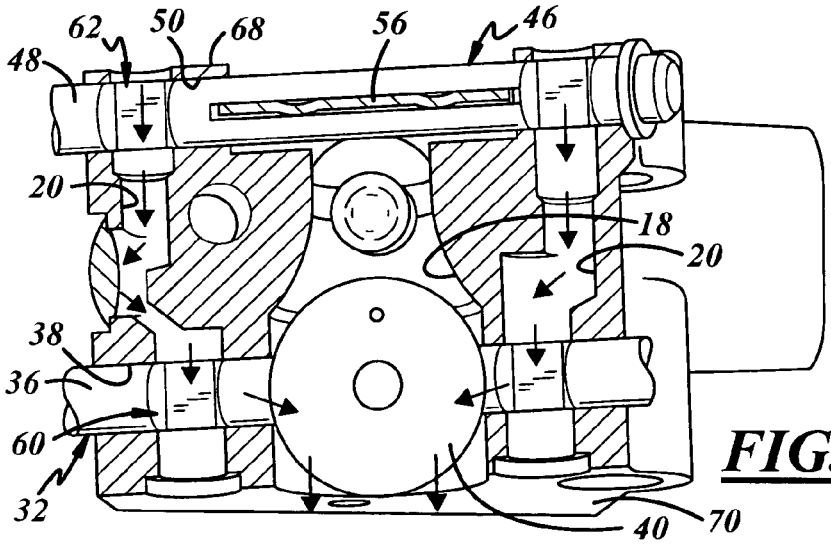
FIG. 10 is a sectional view of a main body of the charge forming device illustrating a fuel and air mixing passage and the air bypass passage formed in the body.

As best shown in FIG. 10, both the throttle valve 32 and the choke valve 46 preferably include at least one bypass valve 60,62, respectively, that selectively permit or control the rate of air flow through the bypass passages 20. In the implementation shown, two bypass valves 60,62 are carried by each of the throttle valve 32 and choke valve 46. The bypass valves 60,62 may be defined or include one or more recesses 64,66 formed in the respective valve shafts 36,48. The recesses 64 extend radially inwardly about one half of the thickness of the shafts 36,48 and axially a distance generally equal to the width of the bypass passages 20, but of course other dimensions could be used. In one implementation, the recesses 66 are formed on either side of a land 67 of the choke valve shaft 48. As also shown in FIG. 10, the bypass passages 20 may extend completely through the block 14 from the choke valve side 68 through the throttle valve side 70. However, the end of the bypass passages 20 at the throttle valve side 70 may be closed off by a gasket when the carburetor 10 is mounted to the engine. Accordingly, the air flow through the bypass passages 20 may follow the arrows in FIG. 10 which show the air flow entering the fuel and air mixing passage 18 through the bore 38 in which the throttle valve shaft 36 is carried. Of course, the bypass valves 60,62 may take other forms, such as relatively flat discs acting as valve heads fastened to the shafts 36,48 for rotation with the shafts or otherwise actuated by rotation of the shafts 36,48, for example.

Accordingly, when the bypass valves 60,62 of both the throttle valve 32 and choke valve 46 are opened, or permit air flow therethrough, air flows through the bypass passages 20 from the choke valve side 68 of the carburetor 10 toward the throttle valve side 70, with that air flow being provided into the fuel and air mixing passage 18 for delivery to the engine. In the implementation shown, the bypass valves 62 associated with the choke valve 46 are open only when the choke valve 46 is closed, or at least substantially closed. The bypass valves 60 of the throttle valve 32 are open when the throttle valve 32 is in its wide open position, or relatively near its wide open position. In one implementation, the air flow through the bypass passages 20 is permitted when the choke valve 46 is rotated at least ⅔ of the way from its open position toward its closed position, and the throttle valve 32 is rotated at least ⅔ of the way from its idle position toward its wide open position. The bypass passage valves 60,62 are preferably opened and closed, and moved between their opened and closed positions, as a function of the position of the throttle valve 32 and choke valve 46, although they may be otherwise moved such as by an operator of the device with which the carburetor is used. In one form, the bypass valves 60,62 are coupled to the throttle valve 32 and choke valve 46 and are driven between their open and closed positions by movement of the throttle and choke valves. In the implementation shown, the bypass valves 60,62 are carried by the throttle valve 32 and choke valve 46 for corotation with these valves.

Figure 6:
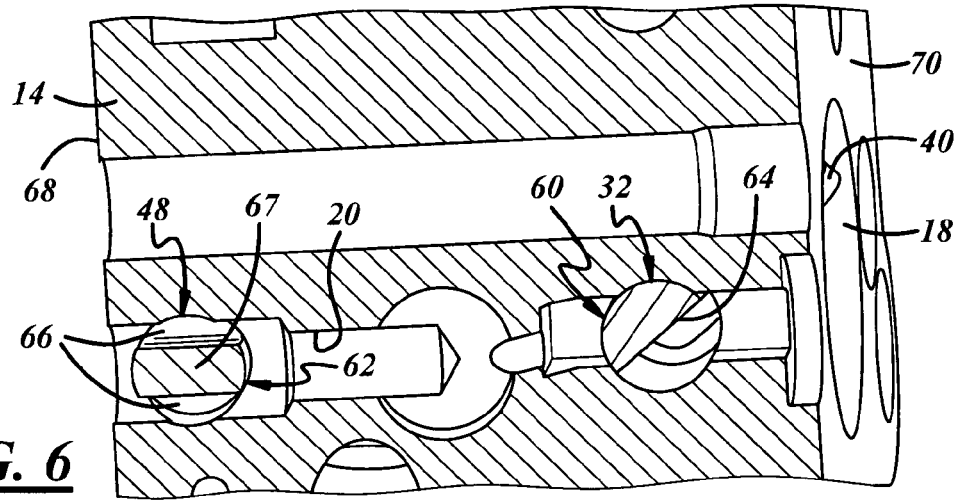
FIG. 6 is a fragmentary sectional view illustrating an air bypass passage in the charge forming device with the choke valve in its closed position and the throttle valve in its idle position.
Figure 8:
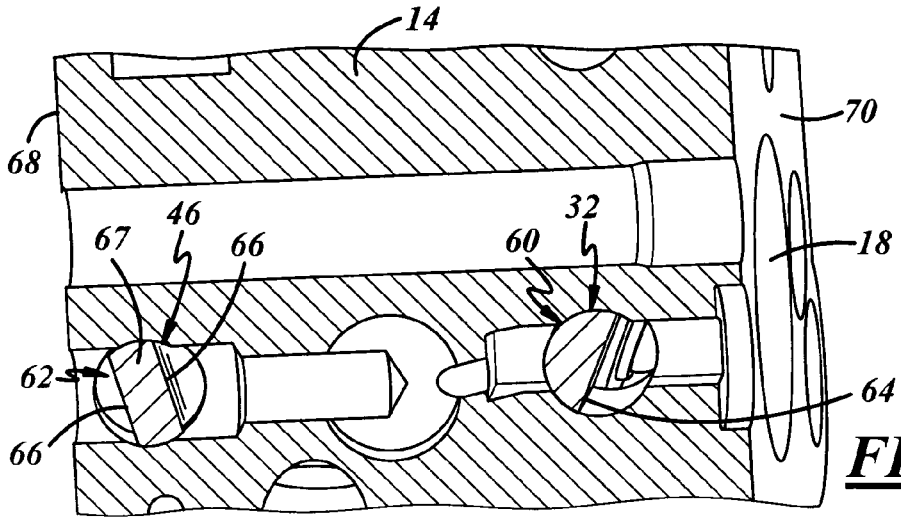
FIG. 8. is a fragmentary sectional view like FIG. 6 illustrating the choke valve in its open position and the throttle valve in its idle position.
Figure 9:
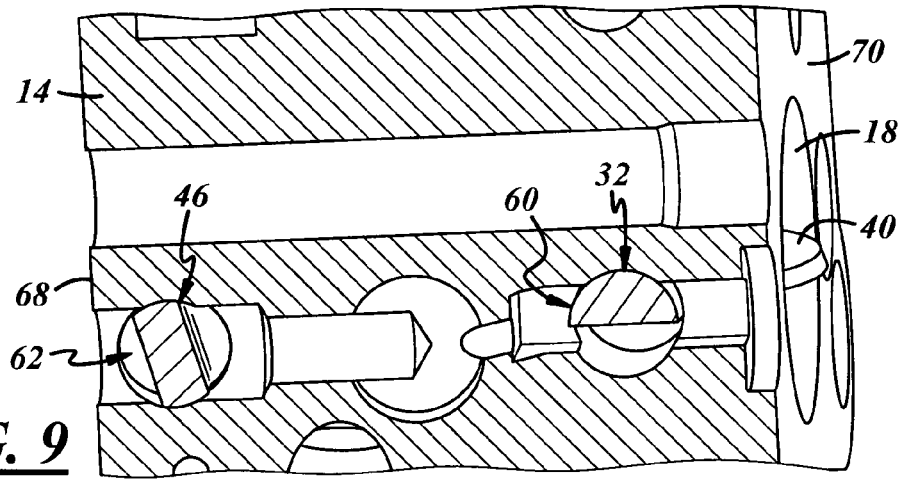
FIG. 9 is a fragmentary sectional view like FIG. 6 illustrating the choke valve in its open position and the throttle valve in its wide open position.

As best shown in FIG. 6, when the choke valve 46 is closed or in a start position wherein the choke valve is substantially closed, the bypass valves 62 associated therewith are open, permitting air flow therethrough and toward the throttle valve side 70 of the carburetor 10. However, when the throttle valve 32 is in its idle position, or a fast idle position such as may be employed during starting of an engine with which the carburetor is used, the bypass valves 60 associated with the throttle valve 32 are in their closed position, preventing air flow therethrough. This prevents or substantially restricts the flow of additional air to the fuel and air mixing passage 18 which would otherwise make the fuel and air mixture undesirably lean for starting and initial warming up of the engine. As shown in FIG. 8, when the choke valve 46 is in its open position, the bypass valves 62 associated with the choke valve 46 are closed, or prevent the flow of air through the bypass passages 20. In FIG. 8, the throttle valve 32 is shown in its idle position and the bypass valves 60 associated therewith also prevent air flow through the bypass passages 20. In FIG. 9, the choke valve 46 is open so that its bypass valves 62 prevent air flow therethrough The throttle valve 32 is in its wide open position, but even though the bypass valves 60 associated therewith are open, no or substantially no air flows through the bypass passages 20 because the bypass valves 62 of the choke valve 46 are closed.

Figure 7:
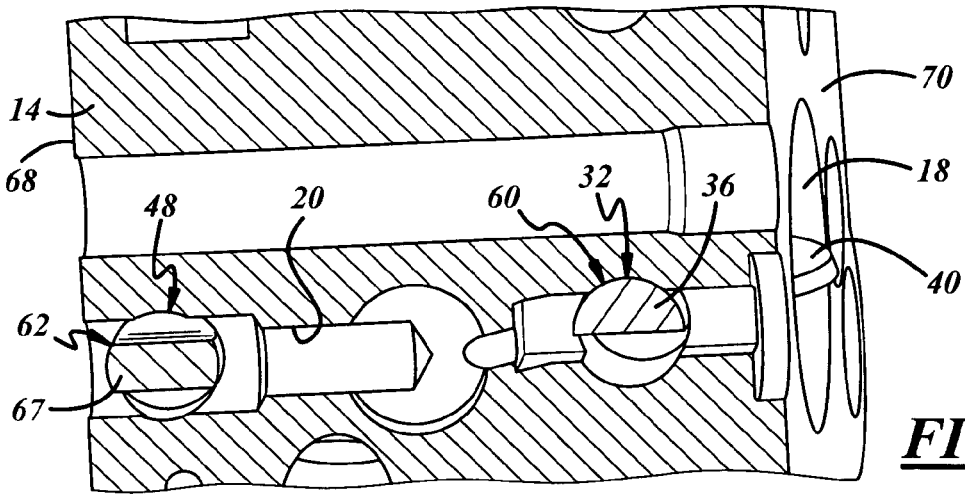
FIG. 7. is a fragmentary sectional view like FIG. 6 illustrating the choke valve in its closed position and the throttle valve in its wide open position.

Accordingly, in this implementation, the bypass passages 20 provide air flow into the fuel and air mixing passage 18 only when, as shown in FIG. 7, the choke valve 46 is in or near its closed position such that the bypass valves 62 associated therewith are open, and the throttle valve 32 is in or near its wide open position, such that the bypass valves 60 associated therewith are also open. The choke and throttle valves may be in this position, for example, when the engine becomes flooded during attempted starts with the throttle valve 32 in its idle position. After this occurs, the throttle valve 32 may be moved to its wide open position permitting increased air flow therethrough, in an attempt to start the engine with a leaner fuel and air mixture. However, with the choke valve 46 closed, there is not much air flow through the fuel and air mixing passage 18. Accordingly, in this situation, the bypass air passages 20 are open and air flows therethrough and into the fuel and air mixing passage 18 to provide a relatively lean mixture and facilitate starting a flooded engine. In this manner, air flow is provided even though the choke valve 46 is closed or substantially closed.

This carburetor 10 may be used, for example, with an engine having an easy start system wherein the choke valve 46 is automatically applied upon pulling a pull cord to start the engine. Such systems couple the choke valve 46 to mechanisms that are moved upon pulling the pull cord. A representative example of such an easy start pull cord system is disclosed in U.S. patent application Ser. No. 11/285,554, now U.S. Pat. No. 7,275,508 which was filed on Nov. 21, 2005, the disclosure of which is incorporated herein by reference in its entirety.

In such systems, the choke valve 46 may be pulled closed as a function of the force resisting pulling of the pull cord such that the choke valve 46 becomes fully closed up to a top dead center position of a piston in the engine and after top dead center, the choke valve 46 may be moved towards its idle position by its return spring 54. When the throttle valve 32 is in its idle position, the choke valve 46 will slip or move back to its start position which may be rotatably spaced or inclined from its fully closed position. The start assist levers 52,42 on both the choke valve 46 and throttle valve 32, respectively, may become engaged with each other to define a start position of both the choke valve 46 and the throttle valve 32. When the throttle valve 32 is in its wide open position upon attempted start of the engine, the start assist levers 42,52 of the throttle and choke valves 32,46 may or may not engage after the force closing the choke valve is reduced. If the levers, 42,52 do not engage in this situation, the choke valve 46 may return to its open position after the piston moves past top dead center if the force of the return spring 54 is greater than the force tending to close the choke valve 46.

In any event, as the choke valve 46 is moved sufficiently towards its closed position when the engine pull cord is pulled to start the engine, the bypass valves 62 associated with the choke valve 46 are open. If the throttle valve 32 is in its wide open position, or sufficiently close thereto, its bypass valves 60 are also opened so that an air flow may occur through the bypass passages 20 and into the fuel and air mixing passage 18. Of course, the flow rate of air through the bypass passages 20 during a wide open throttle engine start, combined with the flow of air through the choke valve 46, can be calibrated for a particular engine or application to provide a desired fuel and air mixture to support starting and continued operation of the engine.

The invention claimed is:

1. A charge forming device, comprising:

a body defining at least part of a fuel and air mixing passage and a bypass passage that communicates with the fuel and air mixing passage;

a throttle valve carried by the body for movement between idle and wide open positions and operable to control at least in part the fluid flow through the fuel and air mixing passage;

a choke valve operably associated with the fuel and air mixing passage, movable between an open position permitting a substantially free flow of air into the fuel and air mixing passage and a closed position at least substantially restricting air flow into the fuel and air mixing passage; and a bypass valve associated with the bypass passage and movable between an open position and a closed position to selectively permit fluid flow through the bypass passage, the bypass valve being movable toward its open position when the throttle valve is displaced at least a threshold amount away from its idle position.

2. The device of claim 1 which also includes a second bypass valve associated with the bypass passage and movable between an open position and a closed position to selectively permit fluid flow through the bypass passage, the valve being movable to its open position when the choke valve is displaced at least a threshold amount away from its open position.

3. The device of claim 1 wherein the bypass valve is carried by the throttle valve and is moved between its positions when the throttle valve is moved between its idle and wide open positions.

4. The device of claim 3 wherein the throttle valve includes a shaft and a valve head carried by the shaft and disposed in communication with the fuel and air mixing passage, and the shaft defines at least in part the bypass valve.

5. The device of claim 4 wherein the body includes a bore in which the throttle valve shaft is rotatably received, and the bypass valve includes a valve head carried by the throttle valve shaft for corotation therewith to control fluid flow through the bypass passage as a function of the rotational position of the throttle valve.

6. The device of claim 5 wherein the valve head is defined at least in part by a portion of the valve shaft including a recess.

7. The device of claim 2 wherein the second bypass valve is carried by the choke valve and is moved between its positions when the choke valve is moved between its open and closed positions.

8. The device of claim 7 wherein the choke valve includes a shaft and a valve head carried by the shaft and disposed in communication with the fuel and air mixing passage, and the shaft defines at least in part the bypass valve.

9. The device of claim 8 wherein the body includes a bore in which the choke valve shaft is rotatably received, and the bypass valve includes a valve head carried by the choke valve shaft for corotation therewith to control fluid flow through the bypass passage as a function of the rotational position of the choke valve.

10. The device of claim 9 wherein the valve head is defined at least in part by a portion of the valve shaft including a recess.

11. The device of claim 2 wherein the first bypass valve is open when the throttle valve is moved sufficiently toward its wide open position and the second bypass valve is open when the choke valve is moved sufficiently toward its closed position.

12. The device of claim 11 wherein the first bypass valve is open when the throttle valve is moved at least ⅔ of the way from its idle position toward its wide open position and the second bypass valve is open when the choke valve is moved at least ⅔ of the way from its open position toward its closed position.

13. The device of claim 1 which also comprises a linkage connecting the choke valve to a starter mechanism so that upon actuation of the starter mechanism the choke valve is automatically moved to its closed position.

14. The device of claim 11 which also comprises a linkage connecting the choke valve to a starter mechanism so that upon actuation of the starter mechanism the choke valve is automatically moved to its closed position.

15. The device of claim 1 which also comprises a second bypass passage that communicates with the fuel and air mixing passage, and another bypass valve associated with the bypass passage and movable between an open position and a closed position to selectively permit fluid flow through the bypass passage, said another bypass valve being movable toward its open position when the throttle valve is displaced at least a threshold amount away from its idle position.

16. The device of claim 15 which also includes a pair of second bypass valves each associated with a different one of the bypass passages and movable between an open position and a closed position to selectively permit fluid flow through the bypass passage, the second bypass valves being movable to their open positions when the choke valve is displaced at least a threshold amount away from its open position.

17. A carburetor, comprising:

a body defining at least part of a fuel and air mixing passage and a bypass passage that communicates with the fuel and air mixing passage;

a throttle valve carried by the body for movement between idle and wide open positions and operable to control at least in part the fluid flow through the fuel and air mixing passage;

a choke valve operably associated with the fuel and air mixing passage, movable between an open position permitting a substantially free flow of air into the fuel and air mixing passage and a closed position at least substantially restricting air flow into the fuel and air mixing passage;

a first bypass valve carried by the throttle valve, associated with the bypass passage and movable between an open position and a closed position to selectively permit fluid flow through the bypass passage, the first bypass valve being movable toward its open position when the throttle valve is displaced at least a threshold amount away from its idle position; and a second bypass valve carried by the choke valve, associated with the bypass passage and movable between an open position and a closed position to selectively permit fluid flow through the bypass passage, the second bypass valve being movable toward its open position when the choke valve is displaced at least a threshold amount away from its open position whereby the bypass passage is open when the choke valve is closed and the throttle valve is wide open to provide additional airflow into the fuel and air mixing passage when starting an engine at wide open throttle.

18. The carburetor of claim 17 which also comprises a second bypass passage that communicates with the fuel and air mixing passage, and wherein two first bypass valves are carried by the throttle valve, one in each of the bypass passages, and two second bypass valves are carried by the choke valve, one in each of the bypass passages.

19. The carburetor of claim 18 wherein the second bypass passage is disposed on an opposite side of the fuel and air mixing passage as the other bypass passage.

* * * * *